US006019710A

United States Patent [19]

Dalebout et al.

[11] Patent Number: 6,019,710

[45] Date of Patent: Feb. 1, 2000

[54] EXERCISING DEVICE WITH ELLIPTICAL MOVEMENT

[75] Inventors: William T. Dalebout, Logan; Steven Mott, Clinton, both of Utah

[73] Assignee: ICON Health & Fitness, Inc., Logan, Utah

[21] Appl. No.: 09/003,322

[22] Filed: Jan. 6, 1998

[51] Int. Cl.[7] ..... A63B 22/04; A63B 69/16

[52] U.S. Cl. ..... 482/70; 482/51

[58] Field of Search ..... 482/51–53, 57, 482/70, 79, 80, 71

[56] References Cited

U.S. PATENT DOCUMENTS

| | | | |
|---|---|---|---|
| 3,316,898 | 5/1967 | Brown . | |
| 5,242,343 | 9/1993 | Miller | 482/57 |
| 5,383,829 | 1/1995 | Miller | 482/57 |
| 5,518,473 | 5/1996 | Miller | 482/57 |
| 5,527,246 | 6/1996 | Rodgers, Jr. | 482/57 |
| 5,529,555 | 6/1996 | Rodgers, Jr. | 482/57 |
| 5,540,637 | 7/1996 | Rodgers, Jr. | 482/52 |
| 5,549,526 | 8/1996 | Rodgers, Jr. | 482/57 |
| 5,562,574 | 10/1996 | Miller | 482/51 |
| 5,573,480 | 11/1996 | Rodgers, Jr. | 482/57 |
| 5,577,985 | 11/1996 | Miller | 482/52 |
| 5,591,107 | 1/1997 | Rodgers, Jr. | 482/57 |
| 5,593,371 | 1/1997 | Rodgers, Jr. | 482/51 |
| 5,593,372 | 1/1997 | Rodgers, Jr. | 482/52 |
| 5,595,553 | 1/1997 | Rodgers, Jr. | 482/51 |
| 5,611,756 | 3/1997 | Miller | 482/52 |
| 5,611,757 | 3/1997 | Rodgers, Jr. | 482/57 |
| 5,611,758 | 3/1997 | Rodgers, Jr. | 482/57 |
| 5,637,058 | 6/1997 | Rodgers, Jr. | 482/51 |
| 5,653,662 | 8/1997 | Rodgers, Jr. | 482/52 |
| 5,683,333 | 11/1997 | Rodgers, Jr. | 482/57 |
| 5,685,804 | 11/1997 | Whan-Tong et al. | 482/51 |
| 5,690,589 | 11/1997 | Rodgers, Jr. | 482/57 |
| 5,743,834 | 4/1998 | Rodgers, Jr. | 482/57 |
| 5,788,610 | 8/1998 | Eschenbach | 482/52 |
| 5,919,118 | 7/1998 | Stearns et al. | 482/70 |

FOREIGN PATENT DOCUMENTS 29 19 494 A1 11/1980 Germany .

*Primary Examiner*—S. Crow
*Attorney, Agent, or Firm*—Workman, Nydegger & Seeley

[57] ABSTRACT

An exercise apparatus includes a base having a support stand upstanding therefrom. A pair of spaced apart foot rails each have a first end and opposing second end. The second end of each foot rail rests on the base of the frame. A pair of stroke rails each have a first end and an opposing second end. The first end of each stroke rail is slidably attached to the support stand of the frame while the second end of each stroke rail is hingedly attached to a corresponding foot rail. An axle of a crank is rotatably mounted to the support stand. A pair of crank arms each orthogonally project from the corresponding ends of the axle in opposing directions. Each remote end of the crank arm is rotatably mounted to a corresponding stroke rail between the ends thereof.

34 Claims, 6 Drawing Sheets

EXERCISING DEVICE WITH ELLIPTICAL MOVEMENT

BACKGROUND OF THE INVENTION

1. The Field of the Invention

The present invention relates to exercise equipment, and, more specifically exercise equipment having elliptical foot displacement.

2. The Relevant Technology

A variety of indoor exercising equipment has been develop to exercise leg muscles commonly used in running, skiing, and other outdoor activities. Such machines include treadmills, stepping machines, and various types of sliding machines. Although effective to some extent, each of these machines has select disadvantages. For example, most treadmills wear quickly under the jarring of heavy jogging or running. Furthermore, treadmills have the drawback of producing high impact on the user's legs and knees. One approach that minimizes jarring is to use a stair stepper. Stair steppers, however, do not develop all of the muscles commonly used in running. Furthermore, such machines are difficult to use in sprint type exercises. Finally, sliding machines require the user to slide their feet back and forth along a horizontal plane. Such movement does not mimic running and thus exercises only a limited range of muscles.

Recent designs in exercise equipment have attempted to resolve some of the above problems by having a pair of spaced apart foot rails wherein each front end rotates in an elliptical path while each rear end moves along a horizontal plane. The center of each foot rail, on which the user's feet are positioned, also rotates in an elliptical path. This elliptical path is substantially similar to that commonly encountered during running. Likewise, since the user's feet never leave the foot rails, minimal impact is produced.

Several problems, however, have been encountered with such designs. For example, such apparatus commonly include a complexity of interrelated moving parts. This complexity increases the cost and time of manufacturing. An additional problem with such machines is that the foot rails operate by traveling over a relatively long transverse distance. As a result, the exercise machine requires a relatively large area to operate, thereby making the machines less practical for home use.

Finally, conventional apparatus are designed so that the foot rails move along a set, predefined path. Users of different heights whose stride does not correspond to the predetermined path of the apparatus can find use of the apparatus to be uncomfortable or even impossible.

OBJECTS AND BRIEF SUMMARY OF THE INVENTION

Accordingly, it is an object of the present invention to provide improved exercise apparatus that produce elliptical foot movement similar to that of running.

Another object of the present invention to provide the above exercise apparatus that have a simpler mechanical design than corresponding prior art designs.

Yet another object of the present invention to provide the above exercise apparatus which require minimal space to operate.

Finally, another object of the present invention is to provide the above exercising apparatus which can be selectively adjusted to match the stride of the user.

To achieve the foregoing objectives, and in accordance with the invention as embodied and broadly described herein, an exercise apparatus is provided. The exercise apparatus includes a frame having a base configured for resting on a ground surface and a support stand upstanding from the base. A hand rail extends from the top of the support stand to each side of the base. Mounted on top of the hand rail above the support stand is a display board. The exercise apparatus further includes a pair of spaced apart, linear foot rails each having a first end and an opposing second end. The second end of each foot rail slidably rests on the base of the frame. The first end of each foot rail is hingedly attached to the second end of a corresponding stroke rail. Each stroke rail also has a first end slidably attached to the support stand of the frame.

A rotatable crank is also mounted to the support stand. The crank includes an axle rotatably attached to the support stand. A pair of crank arms each orthogonally project from a corresponding end of the axle in opposing directions. Outwardly projecting from each end of the crank arms is a rotatable sleeve. The sleeve is welded or otherwise attached to a corresponding stroke rail between the first and second ends thereof.

During operation, an individual stands on the foot rails and moves their feet in opposing but reciprocating motions. The front end of each foot rail rotates in a substantially elliptical pattern as the result of being hingedly attached to the crank. The second end of each foot rail reciprocates back and forth along the base. The user's feet, disposed between the ends of the foot rails, move in an elliptical pattern, thereby simulating a running motion.

In the preferred design, each stroke rail is formed of a curved member with the crank being mounted at or adjacent to the apex of the curve. By using this configuration, the length of the foot rails is minimized, thereby minimizing the space required to operate the exercise apparatus. In an alternative design, a flywheel can be attached to the axle so as to conserve energy produced by the exerciser.

In alternative embodiments, rather than having the stroke rails curved and the foot rails linear, the stroke rails can be linear and each of the foot rails can be curved. The resulting design operates in substantially the same fashion and produces the same effect. Furthermore, rather than having the first end of each stroke rail directly attached to the frame, an adjustment arm can be positioned therebetween. Each adjustment arm includes a first end slidably attached to the frame and a second end slidably received within a corresponding first end of a stroke rail. By extending or retracting the adjustment arm within the corresponding stroke rail, the effective length of the stroke rail is varied. By varying the effective length of the stroke rail, the stride over which the foot rails travel is varied. Accordingly, by selectively positioning each adjustment arm, the path of the foot rails can configured to match the user's stride.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
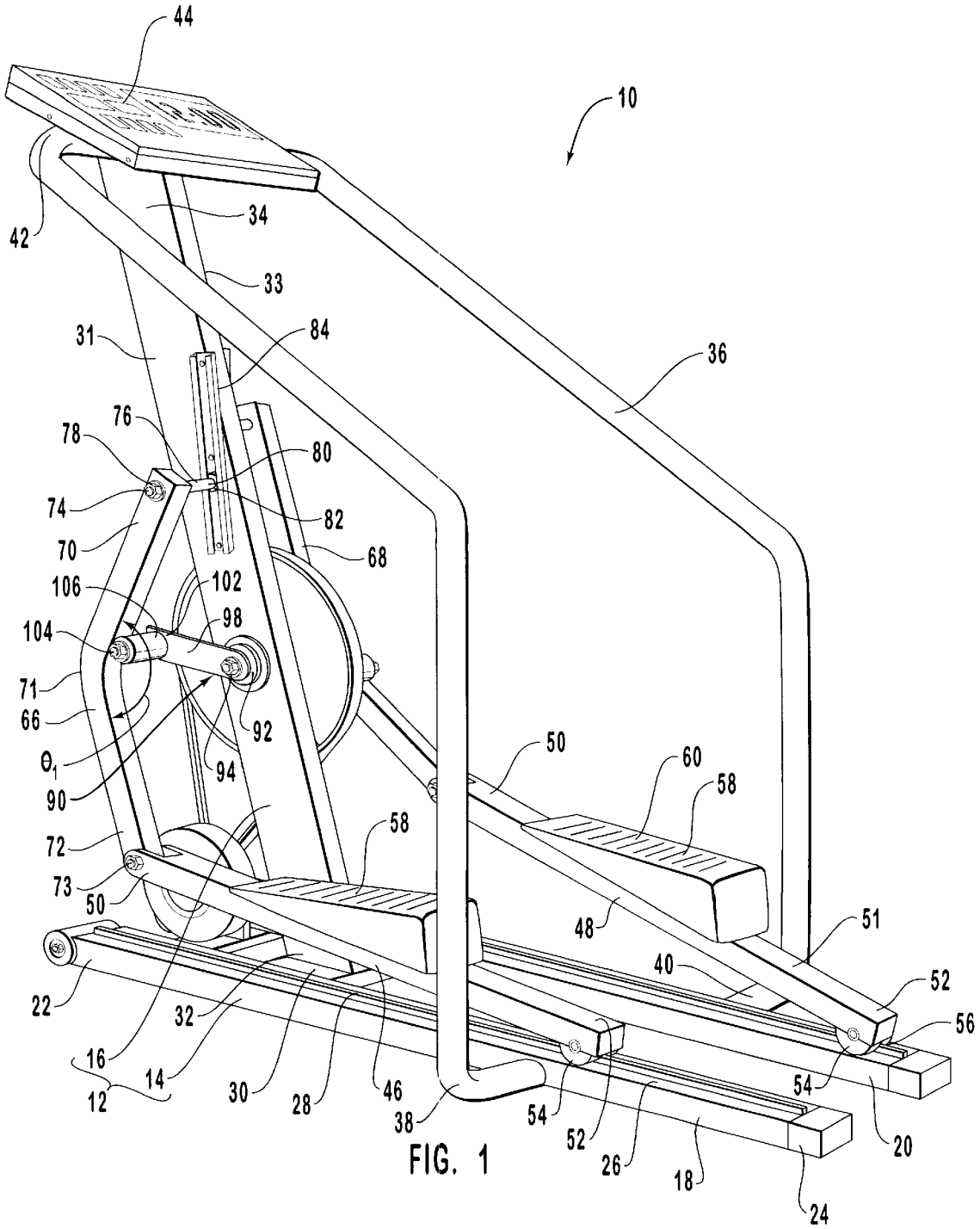
FIG. 1 is a left side perspective view of an exercise apparatus.

Depicted in FIG. 1 is one embodiment of an inventive exercise apparatus 10 incorporating features of the present invention. Exercise apparatus 10 includes a frame 12 comprising a base 14 and a support stand 16 upstanding therefrom. Base 14 includes a pair of spaced apart, elongated tracks 18 and 20. Each of tracks 18 and 20 has a top surface 26 extending between a first end 22 and an opposing second end 24. An alignment ridge 28 upstands from top surface 26 of each track 18 and 20 along the lengths thereof. A cross rail 30 rigidly connects tracks 18 and 20 together.

Support stand 16 has a substantially rectangular transverse cross section with opposing sidewalls 31 and 33. Sidewalls 31 and 33 longitudinally extend between a base end 32 and an opposing top end 34. Base end 32 is securely mounted to cross rail 30.

Mounted to frame 12 is a hand rail 36. Hand rail 36 has a substantially U-shaped configuration with a first end 38 mounted to the outside of track 18 and a second end 40 mounted to the outside of track 20. Hand rail 36 also has a center portion 42 secured to top end 34 of support stand 16. Mounted to center portion 42 over support stand 16 is a display board 44.

Exercise apparatus 10 further includes a linear foot rail 46 positioned on track 18 and a linear foot rail 48 positioned on track 20. Each of foot rails 46 and 48 has a top surface 51 extending between a first end 50 and an opposing second end 52. Positioned on top surface 51 of each foot rail 46 and 48 is a wedge shaped foot pad 58. Each foot pad 58 is configured such that when attached to the corresponding foot rail 46 and 48, a top surface 60 of each foot pad 58 is substantially parallel with the ground.

Rotatably mounted to second end 52 of each foot rail 46 and 48 is a wheel 54. A recessed annular groove encircles each wheel 54. Wheel 54 of foot rail 46 is positioned on top surface 26 of track 18 such that alignment ridge 28 is received within groove 56. Wheel 54 of foot rail 48 is likewise positioned on top surface 26 of track 20 such that alignment ridge 28 thereof is received within groove 56. In this configuration, second end 52 of each foot rail 46 and 48 is free to longitudinally roll along corresponding track 18 and 20 in maintained alignment.

Mounted to first end 50 of foot rail 46 is a curved stroke rail 66. Curved stroke rail 66 has a first end 70, an opposing second end 72, and a curved apex 71 formed therebetween. Curved apex has an inside angle $\theta_1$ in a range between about 120° to about 170° with about 140° to about 160° being preferred. Second end 72 is hingedly mounted to first end 50 of foot rail 46 by a pin 73. The present invention also provides attaching means for attaching first end 70 to support stand 16 so as to simultaneously enable annular rotation and linear displacement of first end 70. By way of example and not by limitation, a pin 76 has a first end 74 transversely extending through first end 70 of stroke rail 66. A nut 78 attaches to first end 74 of pin 76 to prevent separation of stroke rail 66 therefrom. In this position, first end 70 of stroke rail 66 can freely rotate relative the longitudinal axis of pin 76.

Pin 76 also has a second end 80 with a flared head 82 positioned thereat. Flared head 82 is slidably captured within a C-shaped channel 84 that is mounted on support stand 16. First end 70 of stroke rail 66 is thus linearly displaced as pin 76 is slidably moved within channel 84.

Figure 2:
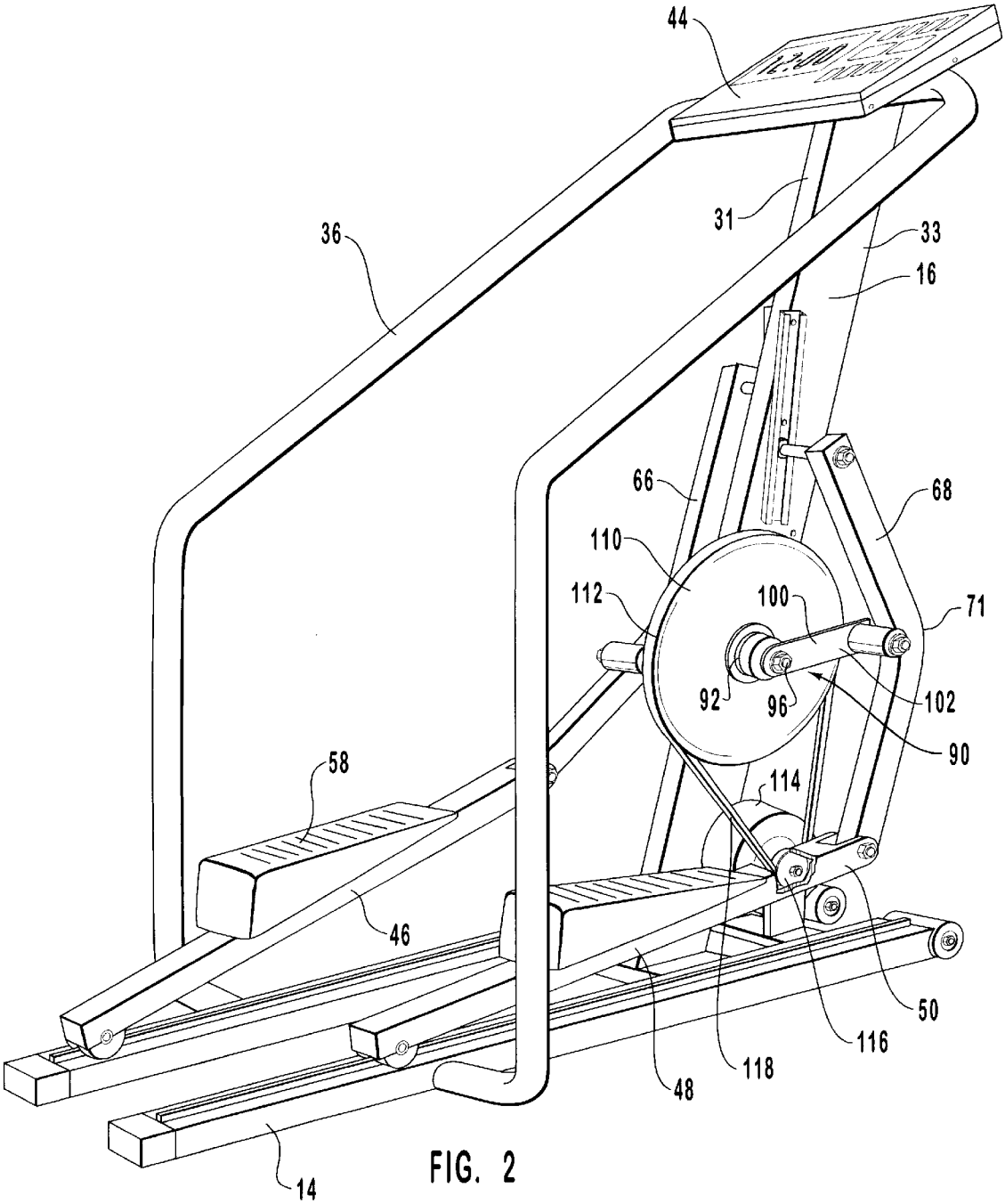
FIG. 2 is a right side perspective view of the exercise apparatus shown in FIG. 1.

As depicted in FIG. 2, a curved stroke rail 68 extends between first end 50 of foot rail 48 and support stand 16. Stroke rail 68 has the same configuration as stroke rail 66 and is attached to foot rail 48 and support stand 16 using the same structures as discussed above with regard to stroke rail 66. Accordingly, like structural elements between stroke rails 66 and 68 and how they are attached are identified by like reference characters.

The present invention also includes connecting means for connecting each stroke rail 66 and 68 to frame 12 such that linear reciprocating displacement of first end 70 of each stroke rail 66 and 68 results in displacement of second end 72 of each stroke rail 66 and 68 in a substantially elliptical path. By way of example and not by limitation, as depicted in FIGS. 1 and 2, a crank 90 is disclosed. Crank 90 includes an axle 92 extending through support stand 16 and being rotatably mounted thereto. Axle 92 has a first end 94 projecting from side 31 of support stand 16 and an opposing second end 96 projecting from side 33 of support stand 16.

A first crank arm 98 is rigidly attached to and orthogonally projects from end 94 of axle 92. A second crank arm 100 is rigidly attached to and orthogonally projects from end 96 of axle 92. Crank arms 98 and 100 project in opposing directions.

The connecting means also includes coupling means for coupling each crank arm 98 and 100 to a corresponding stroke rail 64 and 66 so as to enable free rotation of axle 92. By way of example and not by limitation, each crank arm 98 and 100 terminates at a distal end 102. Outwardly projecting from distal end 102 of first crank arm 98 in substantial parallel alignment with axil 92 is a pin 104. Freely encircling pin 104 is a collar 106. In turn, collar 106 is spot welded or otherwise secured to stroke rail 66 at or adjacent to apex 71.

In like manner, outwardly projecting from distal end 102 of second crank arm 100 in substantial parallel alignment with axil 92 is a pin 105. Freely encircling pin 105 is a collar 107. Collar 107 is spot welded or otherwise secured to stroke rail 68 at or adjacent to apex 71. Crank 90 thus interconnects stroke rails 64 and 66 while still enabling annular rotation of axil 92. As a result of stroke rails 66 and 68 being curved, as opposed to straight, the effective length of foot rails 46 and 48 can be decreased, thereby minimizing the space that exercise apparatus 10 occupies.

During use, an individual faces display board 44 with their feet positioned on corresponding foot pads 58. Foot rails 46 and 48 on which foot pads 58 are mounted are located in displaced or offset position relative to each other as a result of crank arms 98 and 100 projecting in opposing directions. Specifically, as depicted in FIG. 1, with crank arm 98 rotated into a forward position, second end 52 of foot rail 46 is advanced into a forward position while first end 70 of stroke rail 66 is disposed into a lowered position. Simultaneously, second crank arm 100 is oriented in a rearward position with second end 52 of foot rail 48 advanced into a rearward position and first end 70 of stroke rail 68 advanced into an upward position.

Figure 3:
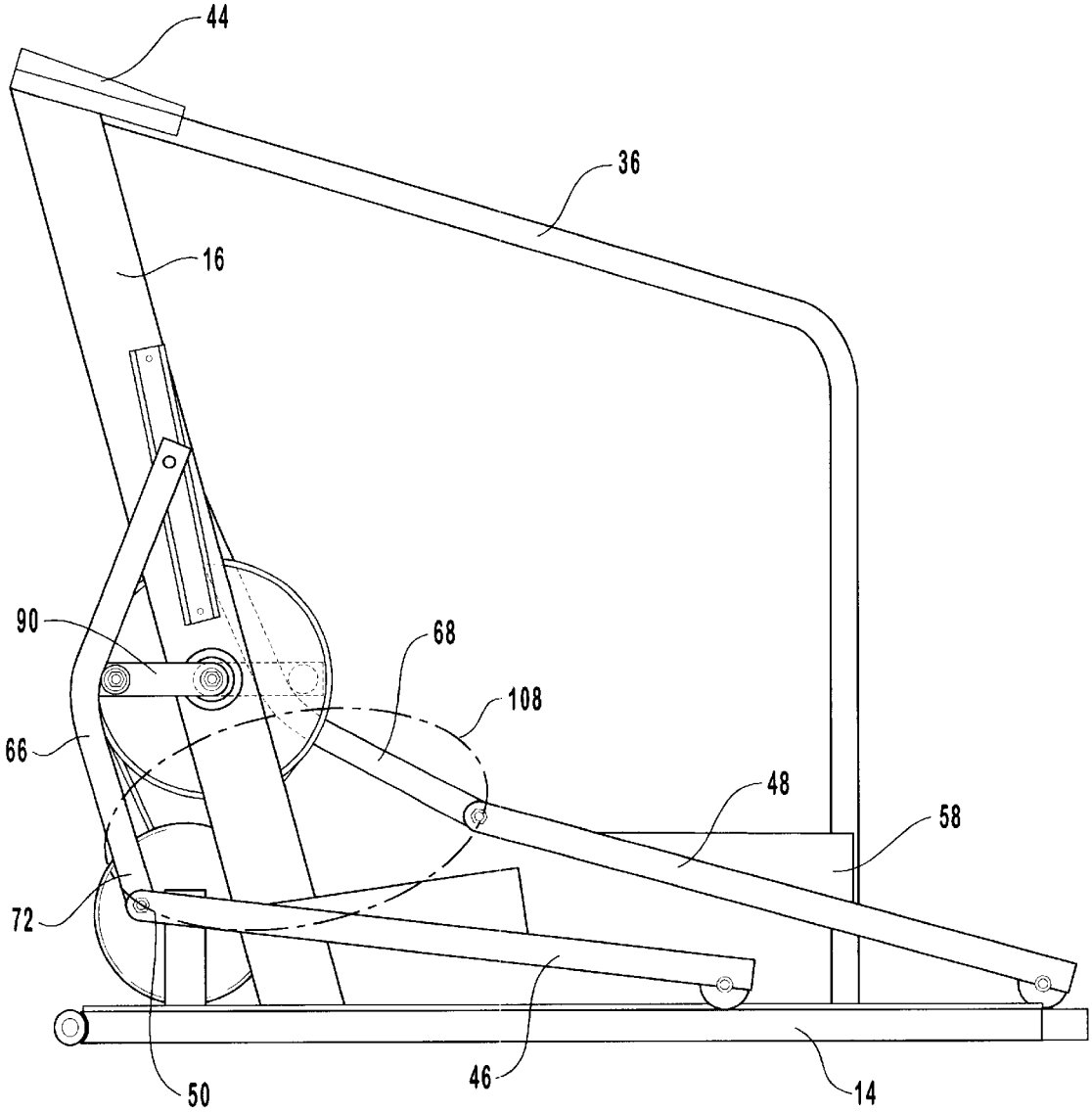
FIG. 3 is a left side view of the exercise apparatus shown in FIG. 1.

As a user applies a down and rearward force on foot pad 58 overlying foot rail 46, crank 90 rotates 180° causing stroke rail 66 and 68 and foot rails 46 and 48 to simultaneously reverse their relative positioned as depicted in FIG. 2. A similar force can then be applied to foot pad 58 overlying foot rail 48, thereby enabling continuous reciprocating displacement of the relative components. During this continued reciprocating motion, the hinged connection between first end 50 of each foot rail 46 and 48 and second end 72 of each stroke rail 66 and 68 rotates in a substantially elliptical path as depicted by dash line 108 in FIG. 3. This elliptical path results in each foot pad 58 also traveling in a substantially elliptical path similar to that occurring during walking or jogging.

In one embodiment of the present invention, means are also provided for conserving momentum generated by rotation of crank 90. As depicted in FIG. 2, by way of example and not by limitation, mounted on axle 92 is an enlarged annular flywheel 110 having a grooved annular edge 112. A weighted wheel 114 is rotatably attached to frame 12 adjacent to flywheel 110. Attached to the side of weighted wheel 114 in axle alignment therewith is a drive wheel 116. A belt 118 loops between flywheel 110 and drive wheel 116. Accordingly, as axle 92 is rotated, flywheel 110 is simultaneously rotated. This force is transferred through belt 118 to drive wheel 116. In turn, weighted wheel 114 is rotated. As a result of the increased weight of wheel 114, once wheel 114 begins to rotate, the force produced therein is transferred back into flywheel 110 to maintain even, continued reciprocating displacement of stroke rails 64 and 66.

Figure 4:
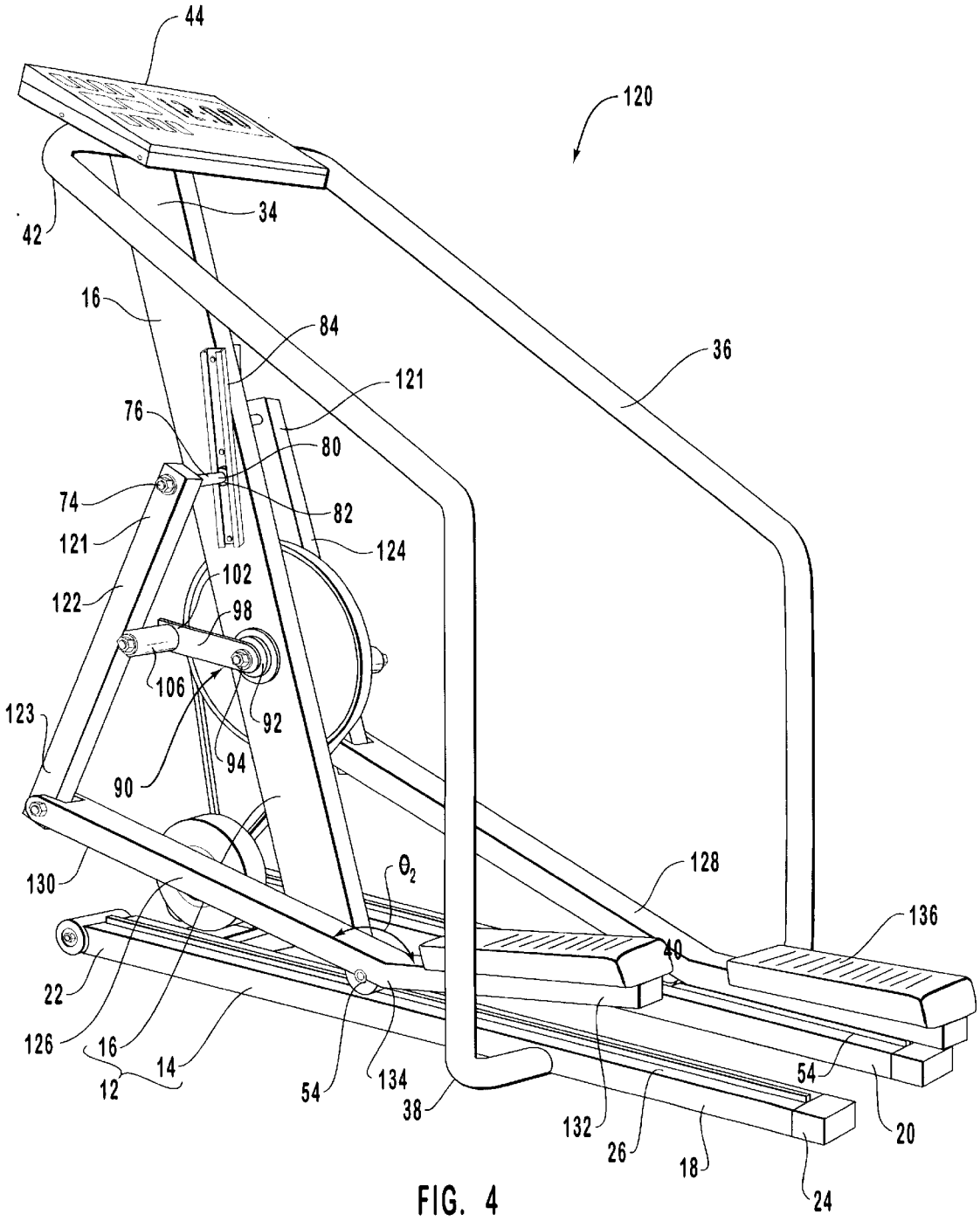
FIG. 4 is a left side perspective view of an alternative embodiment of an exercise apparatus having curved foot rails.

Depicted in FIG. 4 is an alternative embodiment of an inventive exercise apparatus 120. Exercise apparatus 10 and 120 operate in substantially the same way and share many of the same structural elements. Accordingly, like structural elements between exercise apparatus 10 and 120 are identified by like reference characters. In contrast, however, curved stroke rails 66 and 68 of exercise apparatus 10 are replaced by corresponding linear stroke rails 122 and 124. Stroke rails 122 and 124 each have a first end 121 slidably attached to support stand 16 and an opposing second end 123. Furthermore, linear foot rails 46 and 48 of exercise apparatus 10 are replaced by corresponding curved foot rails 126 and 128. Each curved foot rail 126 and 128 has a first end 130, an opposing second end 132, and a curved apex 134 positioned therebetween. First end 130 of each rail 126 and 128 is hingedly attached to a second end 123 of a corresponding stroke rail 122 and 124. Curved apex 134 has an inside angle $\theta_2$ in a range between about 120° to about 170° with about 140° to about 160° being preferred. Mounted at or adjacent to apex 134 is wheel 54 which rides on a corresponding track 18 or 20. Mounted on second end 132 of each foot rail 126 and 128 is a foot pad 136 for receiving a corresponding foot of a user.

Exercise apparatus 120 has many of the same benefits as exercise apparatus 10. For example, compared to conventional apparatus, exercise apparatus 120 has a relatively simple mechanical configuration and requires minimal operating space. Furthermore, operation of exercise apparatus 120, which is the same as that previously discussed with exercise apparatus 10, produces a substantially elliptical displacement of foot pads 136, thereby simulating the movement of walking or running.

Figure 5:
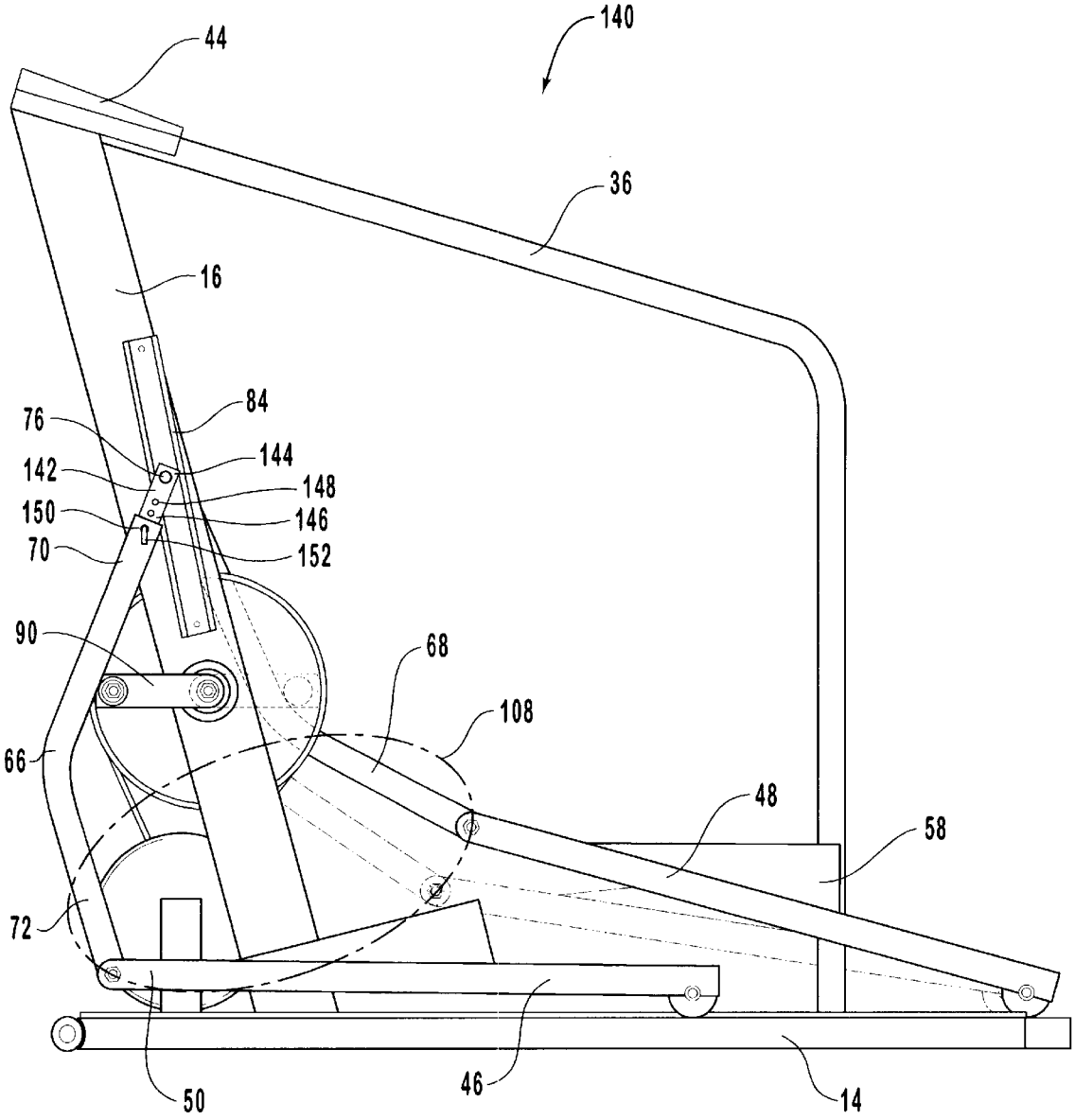
FIG. 5 is a left side view of an alternative embodiment of an exercise apparatus having extendable crank arms.

Depicted in FIG. 5 is yet another alternative embodiment of an exercise apparatus 140. Exercise apparatus 140 is substantially similar to exercise apparatus 10. Accordingly, like structural elements between exercise apparatus 10 and 140 are identified by like reference characters.

In one embodiment of the present invention, means are provided for selectively varying the size of the substantially elliptical path that second end 72 of each stroke rail 66 and 68 travels. By way of example and not by limitation, in contrast to exercise apparatus 10, slidably received with first end 70 of each curved stroke rail 66 and 68 is an adjustment arm 142. Each adjustment arm 142 has a first end 144 from which pin 76 projects for slidable attachment with channel 84. Each adjustment arm 142 also has an opposing second end 146 that is slidably disposed within first end 70 of each stroke rail 66 and 68.

The present invention also includes means for selectively positioning each adjustment arm 142 relative to a corresponding stroke rail 66 and 68. By way of example and not by limitation, a plurality of holes 148 extend through adjustment arm 142 along the length thereof. A complementary hole 150 likewise passes through first end 70 of each stroke rail 66 and 68. Once adjustment arm 142 is slid to a desired position, a pin 152 is passed through aligned holes 150 and 148 so as to securely retain adjustment arm 142 in the desired position.

By selectively extending each adjustment arm 142 out of a corresponding stroke rail 66 and 68 or retracting each adjustment arm 142 into a corresponding stroke rail 66 and 68, the effective length of each stroke rail 66 and 68 varies. As the effective length varies, the size of the elliptical path that second end 72 of stroke rails 66 and 68 travel varies. That is, as the effective length increases, the diameter of the elliptical path increases. Conversely, as the effective length decreases, the diameter of the elliptical path decreases. The size of the elliptical path that foot pads 58 travel varies correspondingly to the elliptical path at second end 72 of stroke rails 66 and 68. Accordingly, by varying the effective length of stroke rails 66 and 68, the path that foot pads 58 travel can be selected to correspond to the stride of the user.

There are a variety of alternative embodiments of the means for selectively varying the size of the substantially elliptical path that second end 72 of each stroke rail 66 and 68 travels. By way of example, stroke rails 66 and 68 can be extended at either end or in the middle. Furthermore, the lengths of foot rail 46 and 48 can also be selectively varied.

Figure 6:
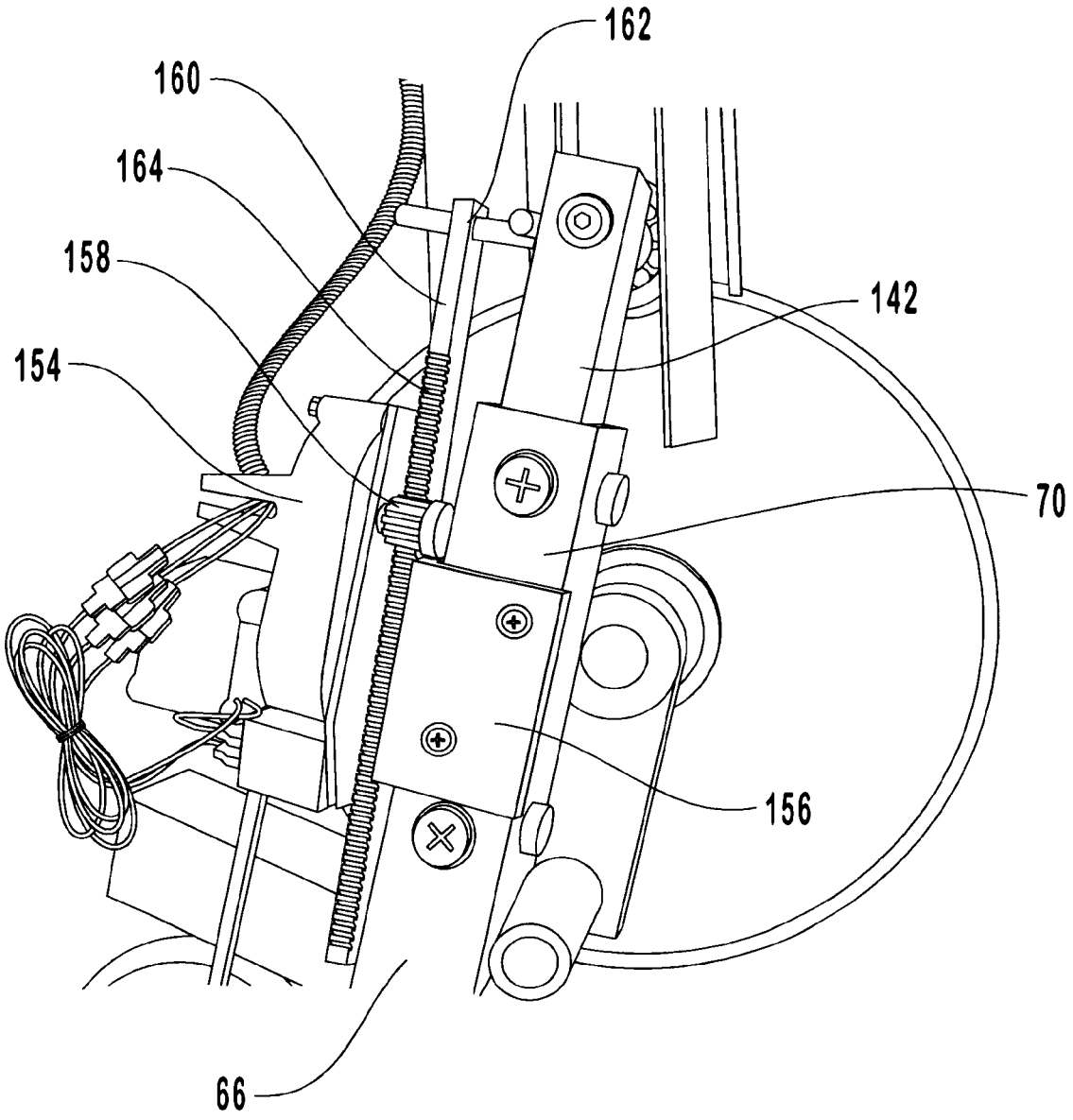
FIG. 6 is a perspective view of an alternative embodiment for moving the adjustable crank arms as depicted in FIG. 5.

Depicted in FIG. 6 is an alternative embodiment of the means for positioning adjustment arm 142 relative to a corresponding stroke rail. As disclosed therein, an electric motor 154 is mounted to second end 70 of stroke rail 66 by a bracket 156. Rotatably extending from motor 154 is a gear 158. An elongated engagement bar 160 has a first end 162 secured to adjustment arm 142 and a plurality of teeth 164 extending along the length thereof. Engagement bar 160 is biased against gear 158 such that teeth 164 engage with gear 158. Accordingly, as motor 154 is energized by a switch, gear 150 is selectively rotated clockwise or counter clockwise. In turn, this rotation selectively raises or lowers engagement bar 160 which in turn selectively raises or lowers adjustment arm 142 relative to stroke arm 66.

In the preferred embodiment, a complementary assembly of the motor 154 and engagement bar 160 are attached to stroke rail 68. Each of the motors 154 can thus simultaneously engage to simultaneously adjust each adjustment arms 142 a desired distance.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An exercise apparatus comprising:

(a) a frame configured for resting on a ground surface;

(b) a pair of spaced apart foot rails each having a first end and an opposing second end, each foot rail being configured to receive a corresponding foot of a user;

(c) a pair of stroke rails each having a first end and an opposing second end, the second end of each stroke rail being hingedly attached to the first end of a corresponding foot rail;

(d) means for connecting each stroke rail to the frame such that linear reciprocating displacement of the first end of each stroke rail results in displacement of the second end of each stroke rail in a substantially elliptical path; and (e) means for selectively varying the size of the substantially elliptical path that the second end of each stroke rail travels.

2. An exercise apparatus as recited in claim 1, wherein the means for connecting comprises:

(i) an axle having opposing ends, the axil being rotatably mounted to the frame;

(ii) a crank arm rigidly mounted on each opposing end of the axil; and (iii) means for coupling each crank arm to a corresponding stroke rail so as to enable free rotation of the axle.

3. An exercise apparatus as recited in claim 2, wherein the means for coupling comprises:

(i) a pin projecting from each crank arm; and (ii) a tubular sleeve rotatably disposed over each pin, each tubular sleeve being rigidly secured to a corresponding stroke rail.

4. An exercise apparatus as recited in claim 2, further comprising means for conserving momentum generated by rotation of the axil.

5. An exercise apparatus as recited in claim 4, wherein the means for conserving momentum comprises:

(a) a flywheel mounted to the axis;

(b) a weighted wheel rotatably mounted to the frame; and (c) a belt extending from the flywheel to the weighted wheel.

6. An exercise apparatus as recited in claim 1, wherein the means for selectively varying comprises a pair of adjustment arms each having a first end slidably mounted to the frame and an opposing second end adjustably mounted to the first end of a corresponding stroke rail.

7. An exercise apparatus as recited in claim 1, wherein the frame comprises a pair of spaced apart tracks and a support stand upstanding therebetween.

8. An exercise apparatus as recited in claim 1, wherein the first end of each stroke rail is slidably attached to the frame.

9. An exercise apparatus as recited in claim 1, wherein each stroke rail is curved.

10. An exercise apparatus as recited in claim 1, wherein each foot rail is curved.

11. An exercise apparatus as recited in claim 1, further comprising a wheel mounted on each foot rail and disposed on the frame.

12. An exercise apparatus comprising:

(a) a frame configured for resting on a ground surface and having an support stand;

(b) a pair of spaced apart foot rails each having a first end and an opposing second end, each foot rail being configured to receive a corresponding foot of a user;

(c) a pair of stroke rails each having a first end and an opposing second end, the first end of each stroke rail being slidably attached to the support stand of the frame, the second end of each stroke rail being hingedly attached to the first end of a corresponding foot rail; and (d) means for connecting each stroke rail to the frame such that linear reciprocating displacement of the first end of each stroke rail results in displacement of the second end of each stroke rail in a substantially elliptical path.

13. An exercise apparatus as recited in claim 12, wherein the means for connecting comprises:

(i) an axle having opposing ends, the axil being rotatably mounted to the frame;

(ii) a crank arm rigidly mounted on each opposing end of the axle; and (iii) means for coupling each crank arm to a corresponding stroke rail so as to enable the axil to continue to freely rotate.

14. An exercise apparatus as recited in claim 13, wherein the means for coupling comprises:

(i) a pin projecting from each crank arm; and (ii) a tubular sleeve rotatably disposed over each pin, each tubular sleeve being rigidly secured to a corresponding stroke rail.

15. An exercise apparatus as recited in claim 13, further comprising means for conserving momentum generated by rotation of the axle.

16. An exercise apparatus as recited in claim 12, wherein each stroke rail is curved.

17. An exercise apparatus as recited in claim 12, wherein each foot rail is curved.

18. An exercise apparatus as recited in claim 12, further comprising a wheel mounted on each foot rail and disposed on the frame.

19. An exercise apparatus as recited in claim 12, wherein the second end of each foot rail is freely suspended above a portion of the frame.

20. An exercise apparatus as recited in claim 12, further comprising a foot pad mounted on each foot rail.

21. An exercise apparatus as recited in claim 12, further comprising a hand rail attached to the support stand of the frame.

22. An exercise apparatus as recited in claim 12, further comprising a pair of adjustment arms each having a first end slidably mounted to the frame and an opposing second end adjustably mounted to the first end of a corresponding stroke rail.

23. An exercise apparatus comprising:

(a) a frame configured for resting on a ground surface and having a support stand;

(b) first and second crank arms rotatably mounted to the support stand of the frame, the crank arm rotating about a fixed axis;

(c) first and second foot rails having a first end and an opposing second end, a portion of the first foot rail movably resting on the frame;

(d) stroke means extending between the crank arms and the hingedly attached to said four rails & for rotating the end of the first foot rails in a substantially elliptical path when the crank arms are rotated in a circular path.

24. An exercise apparatus as recited in claim 23, wherein the stroke means comprises a first stroke rail having a first end and an opposing second end, the second end of the first stroke rail being hingedly attached to the first end of the first foot rail, the crank arm being attached to the first stroke rail between the first end and the second end thereof, the crank arm being attached so as to enable rotation of the crank arm.

25. An exercise apparatus as recited in claim 24, further comprising an adjustment arm having a first end slidably mounted to the frame and an opposing second end adjustably mounted to the first stroke rail.

26. An exercise apparatus as recited in claim 23, further comprising means for conserving momentum generated by rotation of the crank arm.

27. An exercise apparatus as recited in claim 24, wherein the first stroke rail is linear and the first foot rail is curved.

28. An exercise apparatus as recited in claim 24, wherein the first stroke rail is curved and the first foot rail is linear.

29. An exercise apparatus as recited in claim 23, further comprising:

(a) a second crank arm rotatably mounted to the support stand of the frame, the second crank arm rotating about a fixed axis;

(b) a second foot rail having a first end and an opposing second end; and (c) a second stroke rail having a first end slidably attached to the support stand of the frame and a second end hingedly attached to the first end of the second foot rail, the second crank being attached to the second stroke rail between the first and second ends thereof.

30. An exercise apparatus comprising:

(a) a frame comprising a base configured for resting on a ground surface and an support stand;

(b) a pair of spaced apart foot rails each having a first end and an opposing second end, a portion of each foot rail resting on the base of the frame;

(c) a pair of adjustment arms each having a first end slidably attached to the support stand and an opposing second end;

(d) a pair of stroke rails each having a first end and an opposing second end, the second end of each stroke rail being hingedly attached to the first end of a corresponding foot rail; and (e) means for adjustably attaching the second end of the adjustment arm to a corresponding stroke rail.

31. An exercise apparatus as recited in claim 30, wherein the means for adjustable attaching comprises the second end of each adjustment arm being configured to be received within the first end of a corresponding stroke rail.

32. An exercise apparatus as recited in claim 30, further comprising a rotatable crank including:

(i) an axil having opposing ends, the axle being rotatably mounted to the support stand of the frame;

(ii) a pair of crank arms each orthogonally projecting from a corresponding end of the axle in opposing directions; and (iii) means for coupling each crank arm to a corresponding stroke rail between the first and second end of the corresponding stroke rail such that as the second end of each foot rail reciprocates in a lateral movement, the first end of each foot rail moves in an elliptical path.

33. An exercise apparatus as recited in claim 30, wherein each of the stroke rails are curved.

34. An exercise apparatus as recited in claim 30, wherein each of the foot rails are curved.

* * * * *

UNITED STATES PATENT AND TRADEMARK OFFICE

CERTIFICATE OF CORRECTION

PATENT NO. : 6,019,710

DATED : Feb. 1, 2000

INVENTOR(S) : William T. Dalebout; Steven Mott

It is certified that error appears in the above-identified patent and that said Letters Patent are hereby corrected as shown below:

Col. 1, line 12, change "develop" to --developed--

Col. 1, line 56, after "invention" insert --is--

Col. 1, line 60, after "invention" insert --is--

Col. 2, line 52, after "can" insert --be--

Col. 4, line 40, after "from" insert --second--

Col. 4, line 49, after "with" change "axil" to --axle--

Col. 4, line 58, change "axil" to --axle--

Col. 5, line 11, after "relative" change "positioned" to --position--

Col. 6, line 62, after "stroke" change "arm" to --rail--

Col. 6, line 67, change "arms" to --arm--

Col. 7, line 29, change "axil" to --axle--

Col. 7, line 32, change "axil" to --axle--

Col. 7, line 44, change "axil" to --axle--

Col. 8, line 3, after "having" change "an" to --a--

UNITED STATES PATENT AND TRADEMARK OFFICE

CERTIFICATE OF CORRECTION

PATENT NO. : 6,019,710

DATED : Feb. 1, 2000

INVENTOR(S) : William T. Dalebout; Steven Mott

It is certified that error appears in the above-identified patent and that said Letters Patent are hereby corrected as shown below:

Col. 8, line 20, change "axil" to --axle--

Col. 8, line 25, change "axil" to --axle--

Col. 8, line 67, after "said" change "four rails &" to --first foot rail--

Col. 9, line 1, after "the" insert --first-- and after "foot" change "rails" to --rail--

Col. 9, line 2, after "circular" change "path." to --path; wherein said stroke means is slidably mounted in the frame--

Col. 9, line 36, after "and" change "an" to --a--

Col. 10, line 20, after "an" change "axil" to --axle--

Signed and Sealed this

Third Day of April, 2001

*Attest:*

Nicholas P. Godici

NICHOLAS P. GODICI

*Attesting Officer*

*Acting Director of the United States Patent and Trademark Office*